US006638298B1

(12) United States Patent
Shefflin

(10) Patent No.: US 6,638,298 B1
(45) Date of Patent: Oct. 28, 2003

(54) PACIFIER CLIP AND COVER

(76) Inventor: Joanne Shefflin, 850 Highland Ave., Piedmont, CA (US) 94611

( * ) Notice: Subject to any disclaimer, the term of this patent is extended or adjusted under 35 U.S.C. 154(b) by 101 days.

(21) Appl. No.: 10/010,864

(22) Filed: Nov. 8, 2001

Related U.S. Application Data

(60) Provisional application No. 60/246,786, filed on Nov. 8, 2000.

(51) Int. Cl.[7] ..... A61J 17/00
(52) U.S. Cl. ..... 606/234
(58) Field of Search ..... 606/234, 235, 606/236; D24/193–196; 215/11.1, 11.4, 11.6

(56) References Cited

U.S. PATENT DOCUMENTS

| | | | | | |
|---|---|---|---|---|---|
| 4,329,996 | A | | 5/1982 | Copeland | 128/359 |
| 4,417,613 | A | | 11/1983 | Ryan et al. | 150/52 R |
| D276,939 | S | | 12/1984 | Pascoe | D24/46 |
| 4,765,037 | A | | 8/1988 | Perry | 24/301 |
| 4,823,438 | A | | 4/1989 | Roloff | 16/307 |
| 4,946,054 | A | | 8/1990 | Maniero et al. | 215/11.6 |
| 4,990,157 | A | | 2/1991 | Roberts et al. | 606/234 |
| 5,156,617 | A | | 10/1992 | Reid | 606/234 |
| 5,318,191 | A | | 6/1994 | Pomales et al. | 215/11.6 |
| 5,607,452 | A | * | 3/1997 | Michaud | 606/234 |
| 5,948,003 | A | | 9/1999 | Shefflin | 606/234 |
| 5,954,749 | A | * | 9/1999 | Fields et al. | 606/234 |

* cited by examiner

*Primary Examiner*—Kevin T. Truong
(74) *Attorney, Agent, or Firm*—Stallman & Pollock LLP

(57) ABSTRACT

A pacifier clip and cover combination includes a clip/cover assembly and a ribbon. The clip/cover assembly includes a cover movable between opened and closed positions and is preferably large enough to fit over and fully cover the nipple portion of a standard pacifier and to therefore protect the nipple from contact with the surrounding environment and keep it clean during storage. The ribbon is attached between the clip/cover assembly and a standard pacifier. Thus, during use, the clip is clipped to an infant's clothing to prevent the pacifier from falling to the ground.

18 Claims, 8 Drawing Sheets

PACIFIER CLIP AND COVER

RELATED APPLICATIONS

This application claims the benefit of U.S. Provisional Application No. 60/246,786, filed Nov. 8, 2000.

BACKGROUND OF THE INVENTION

Currently available infant products include infant pacifiers, pacifier covers and pacifier clips. Some pacifiers are sold with pacifier covers, the purpose of which is to keep pacifier nipples clean and protected from damage when not in use.

Pacifier covers are often part of the packaging with which the pacifier is sold, and are not designed for long term use despite the need for protecting the pacifier. Some pacifier covers fully surround the entire pacifier and include closures at one end.

A problem with these existing covers is that they are not tethered in any way to the pacifier. Thus, they must be separated from the pacifier completely while the pacifier is in use. As a result, the covers are frequently lost and easily broken and thus difficult to find when it comes time to re-cover the pacifier. Thus there is reason for improvement in this regard.

The purpose of a pacifier clip is to prevent the pacifier from falling to the floor when the infant takes the pacifier out of his or her mouth. A typical pacifier clip generally consists of a pinch clip glued to the back of a piece of plastic which is large enough in width and length to pass the small parts test for products which may present choking hazards for children. A ribbon connects the pacifier clip to a pacifier, and the pacifier clip is attached to the infant's clothing at a location which will permit the pacifier to reach the infants mouth. In this manner, a pacifier clip prevents loss of the pacifier to which it is attached. Pacifier clips are frequently sold together with pacifiers, although they are also sold as separate items.

While pacifier clips are extremely useful, they serve only to clip the pacifier to the infant and they thus do not provide for the protection of the pacifier nipple during storage. Thus, there is a need for a single product that can achieve the functions of both the clip and the cover.

Accordingly, it is an object of this invention to provide an improved pacifier cover that can also be attached to an infant's clothing in the same manner as a pacifier clip, that is easily accessible so that it can be positioned over the nipple for protection during storage of the pacifier, and that may remain detachably connected to any standard pacifier at all times, including during use of the pacifier.

Another object of this invention is to provide a pacifier clip which can serve as a pacifier cover while the pacifier is not is use, and which, during use of the pacifier, can be attached to an infant or its clothing, for the purpose of preventing the pacifier from falling to the floor when the infant takes the pacifier out of its mouth and to prevent loss of the pacifier.

This invention is a single article which includes each of the above functions.

SUMMARY OF INVENTION

In view of the above, it would be desirable to have an improved device capable of performing pacifier clipping and covering functions. Specifically, it would be desirable to have a pacifier cover for keeping a pacifier nipple clean and protected during non-use of the pacifier and to have the same cover attached to a clip that can be attached to an infants clothing to prevent the pacifier from falling on the floor where it can become lost or soiled.

Therefore, the pacifier clip/cover assembly of the present invention comprises a clip permanently or removably attached to a cover. The clip is configured for attachment to an infant's clothing. The cover fits over the nipple portion of a pacifier in a full covering position. This protects the nipple from contact with the surrounding environment and keeps it clean when stored in this manner.

A ribbon is removably or permanently attached between the clip/cover assembly and a standard pacifier. This allows the pacifier clip/cover assembly and the pacifier to remain attached to one another substantially at all times. The ribbon may be detachable from the clip/cover assembly and from the pacifier using a releasable means such as velcro or a snap.

These and other objects, features, and advantages of the clip/cover assembly will be more apparent from the following description and drawings.

DETAILED DESCRIPTION

With reference to the drawings, four embodiments of the present invention will be described. The pacifier clip/cover assembly (also described herein using the term "clip and cover") is broadly denoted by the numeral 10 as shown in FIGS. 1–7C. Each device shown is an all-in-one device capable of performing pacifier clipping and covering functions on a variety of standard pacifiers.

Figure 1:
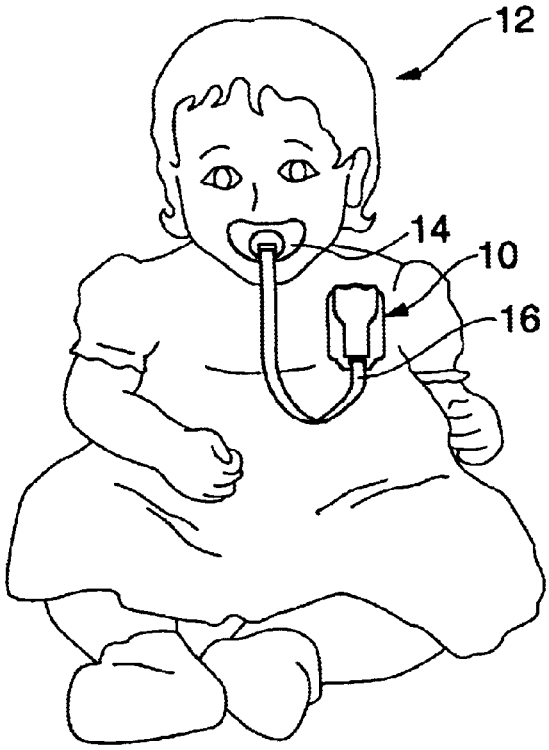
FIG. 1 is a perspective view of an embodiment of a pacifier clip/cover assembly utilizing principles of the present invention, shown attached to an infant.
Figure 2:
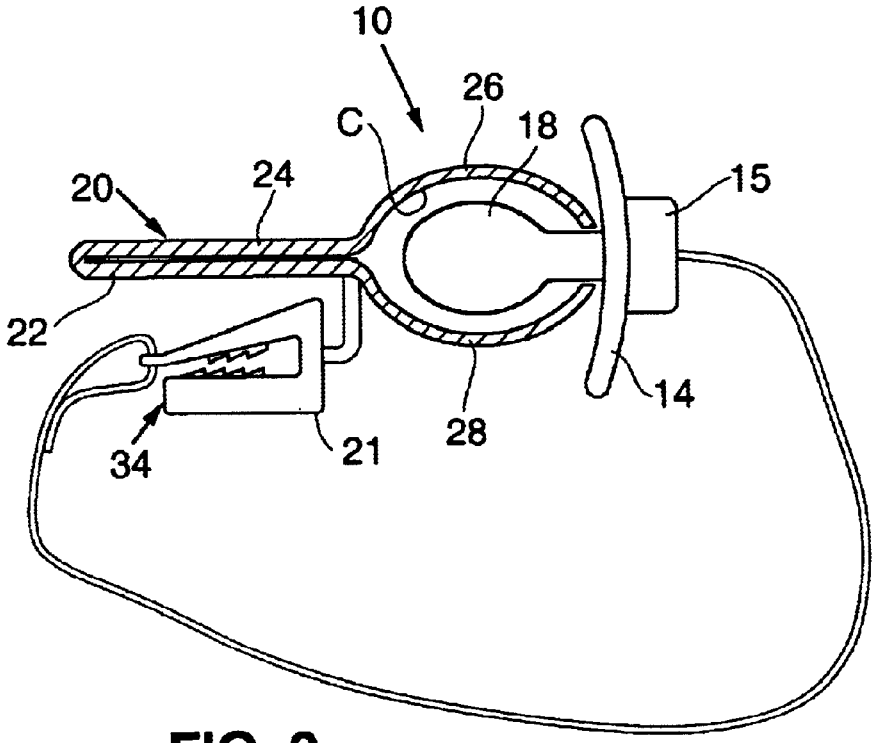
FIG. 2 is a side elevation view of one embodiment of the pacifier clip/cover assembly of FIG. 1 with the cover in the closed position over the nipple portion of a pacifier. The cover portion is shown in cross-section.
Figure 3:
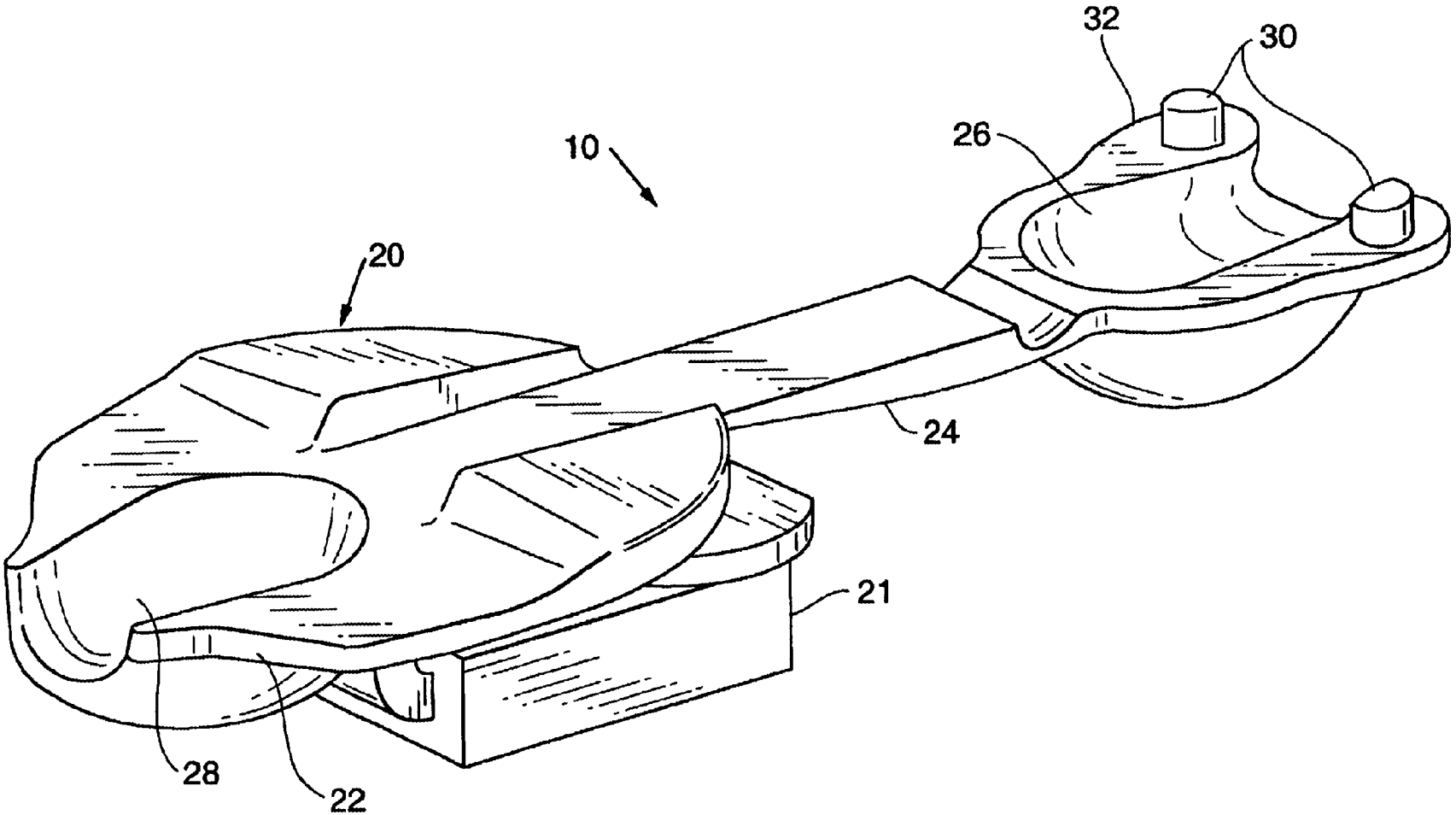
FIG. 3 is a top perspective view of the pacifier clip/cover assembly of FIG. 2 with the cover in the opened position.
Figure 4:
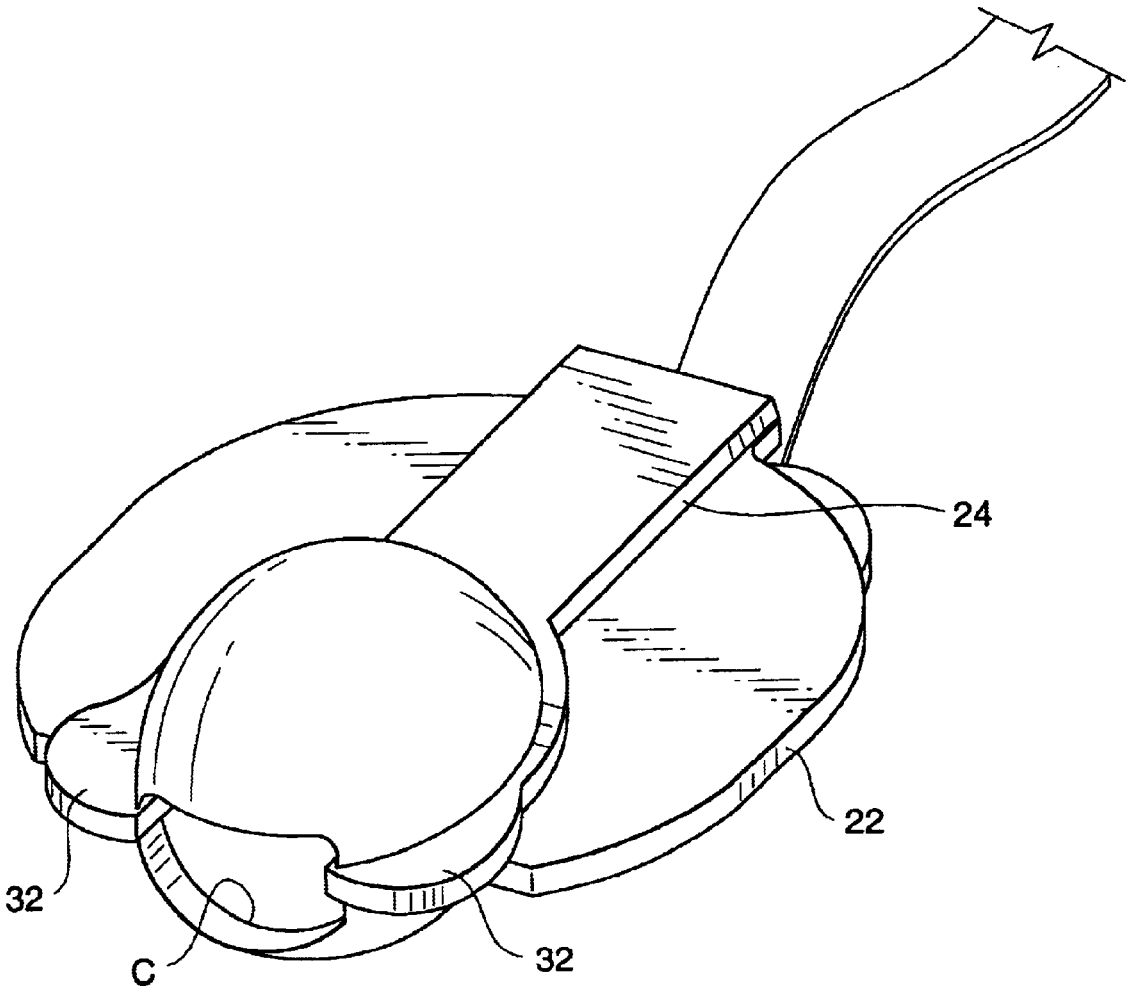
FIG. 4 is a top perspective view of the pacifier clip/cover assembly of FIG. 2 with the cover in the closed position.

FIGS. 1 and 2 illustrate the clip and cover 10 in use. The pacifier clip and cover 10 has two uses intended to keep the pacifier 14 clean, to prevent the pacifier from getting lost, and to prevent the pacifier cover itself from getting lost during use of the pacifier.

FIG. 1 shows one use of the clip and cover 10, in which it is attached to an infant 12 and to a standard pacifier 14. When used in this manner, the clip and cover 10 prevents the pacifier from getting lost or dirty when it falls from the infant's mouth. It also prevents the cover from becoming lost so that it may be used to cover the pacifier nipple when the pacifier is not being used.

FIG. 2 shows the second use of the pacifier clip and cover 10 in which it is used to enclose the nipple 18 on a standard or specialized pacifier 14. The clip and cover 10 is combined with the pacifier 14 in this manner when the pacifier is not in use in order to keep the nipple 18 clean. When the nipple is covered, the clip/cover assembly may be attached by clip to the child's clothing, or it may be separate from the child's clothing for storage.

Referring still to FIG. 2, the pacifier clip and cover 10 includes a cover 20 and a clip 21. Cover 20 may take a variety of forms, but in the embodiments shown herein it is formed of a plate 22 and an arm 24 hinged to the plate 22. Plate 22 and arm 24 act as jaw members and are thus pivotable relative to one another between an opened position (FIG. 3) and a closed position (FIG. 2). Plate 22 and arm 24 each include rounded recesses 26, 28 such that when the cover is in the closed position, the recesses 26, 28 form a cavity C between them for enclosing a pacifier nipple in the manner shown in FIG. 2. Snap latches 30 (FIG. 3) may be provided on the arm 24 for friction engagement with the plate when the cover is closed. Naturally, such latches may alternatively be positioned on the plate for engagement with the arm. Finger tabs 32 may be provided to facilitate closing and opening of the cover. Preferably, the cover is configured to cover only the nipple portion of a pacifier as shown in FIG. 2, leaving the mouthpiece portion 15 uncovered.

Figure 5A:
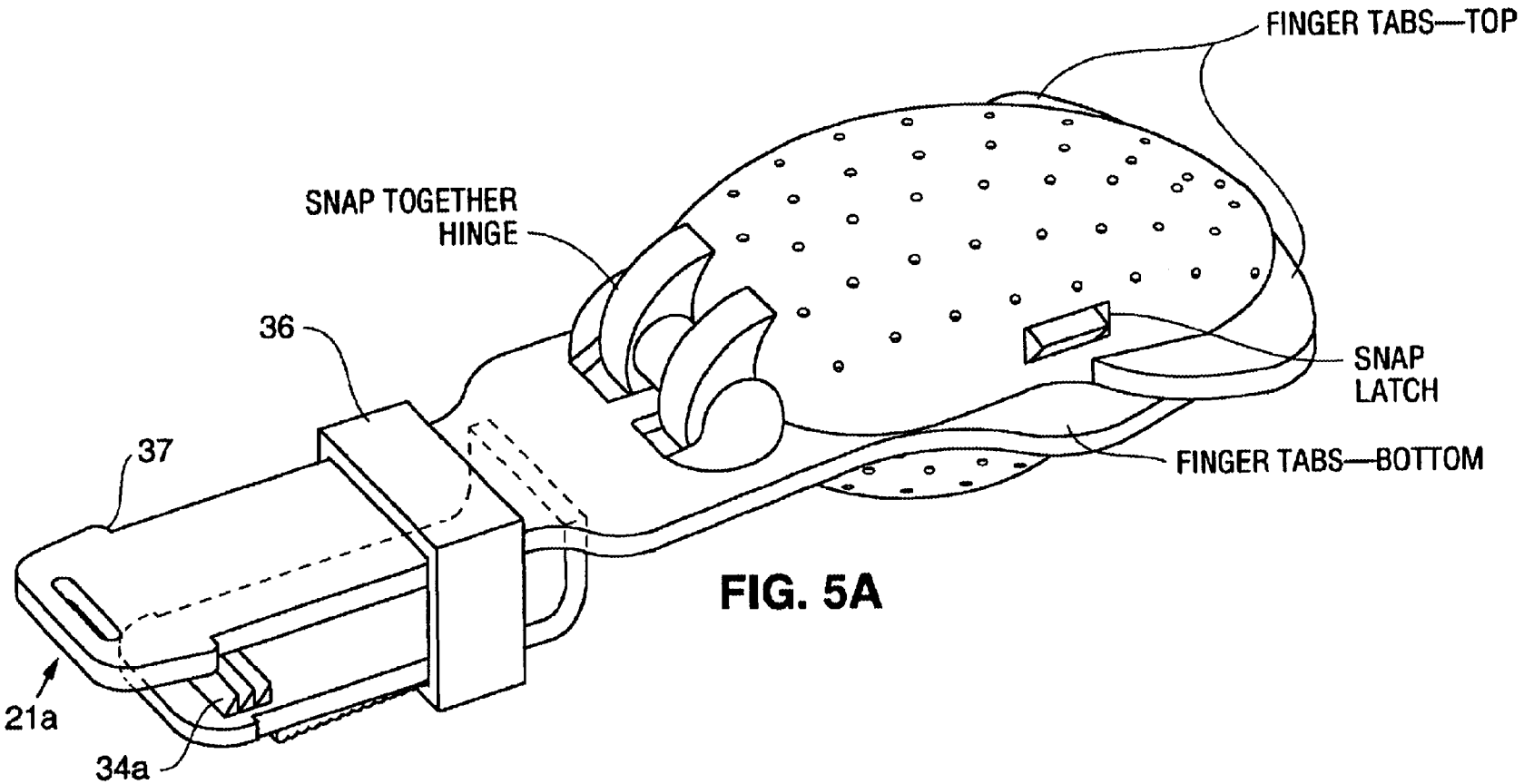
FIG. 5A is a perspective view of a second embodiment of the pacifier clip/cover assembly of FIG. 1.
Figure 5B:
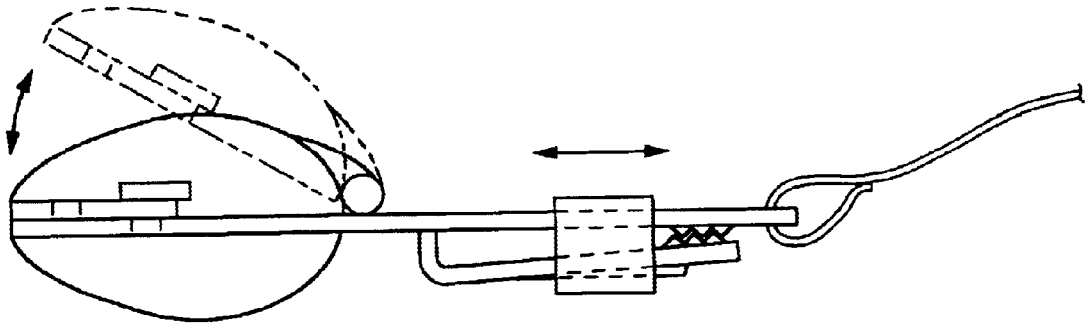
FIG. 5B is a side elevation view of the embodiment of FIG. 5A. Dashed lines indicate the orientation of the cover in the opened position.
Figure 5C:
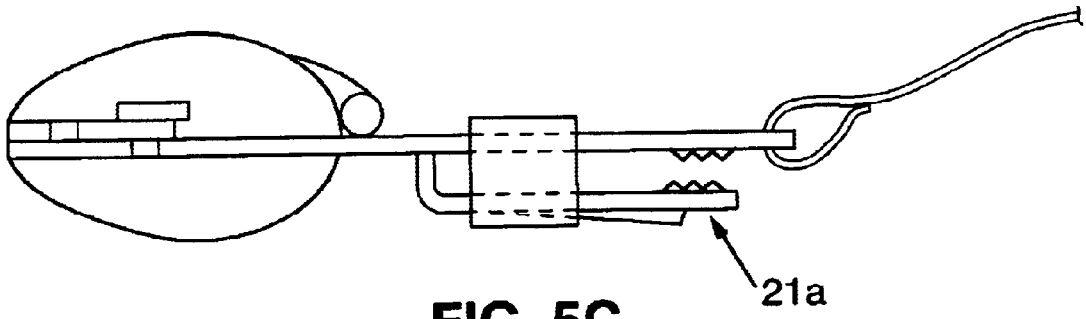
FIG. 5C is a side elevation view similar to FIG. 5B but showing the clip in the opened position.

The clip 21 functions to secure the clip/cover assembly 10 to an infant's clothing. Clip 21 may take a variety of forms, including the forms shown herein as well as others. For example, referring to FIG. 2, clip 21 may simply be a pair of jaws 34 that are opened by prying them using one's fingers. This form of jaws may further include a slide lock 36 as shown in FIGS. 5A through 5C for securing the jaws in opened position. A safety retainer 37, in the form of a broadened section of one of the jaw members, prevents slide lock 36 from falling off of the jaws 34*a*.

Figure 6A:
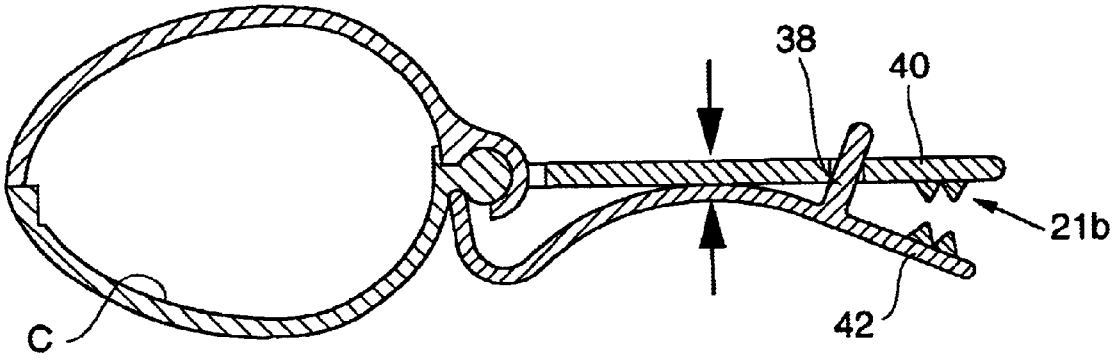
FIG. 6A is a cross-sectional side view of a third embodiment of a pacifier clip and cover of FIG. 1 showing the clip in the opened position.
Figure 6B:
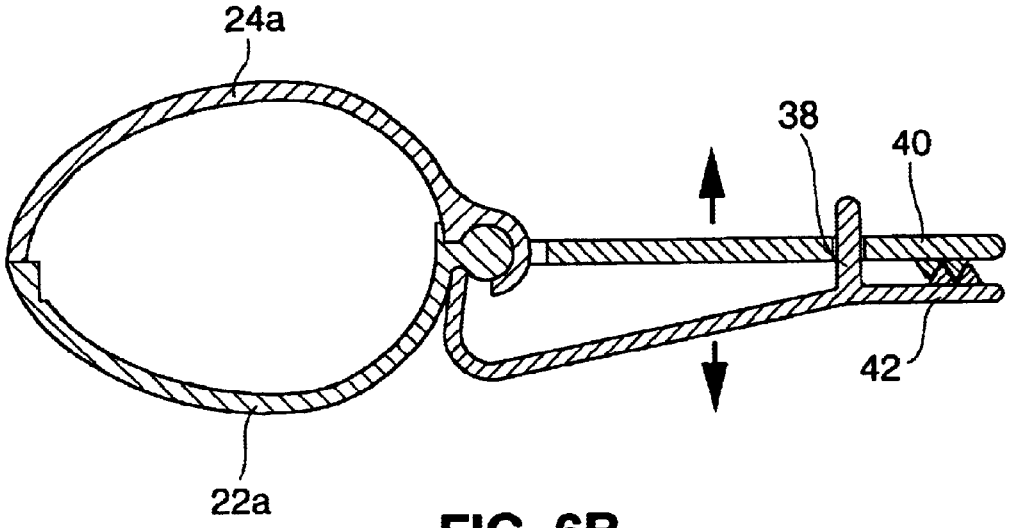
FIG. 6B is a cross-sectional side view similar to FIG. 6A but showing the clip in the closed position.

As another alternative, shown in FIGS. 6A and 6B, the jaws may include a fulcrum 38 positioned between jaw member 40, 42. In this embodiment, clip is configured such that squeezing the jaw members as indicated in FIG. 6A causes jaw member 42 to pivot about the fulcrum 38, resulting in opening of the jaws. The jaw material is sufficiently resilient to allow the jaw members 42 to return to the closed position as shown in FIG. 6B once pressure against the jaw members has been stopped.

Figure 7A:
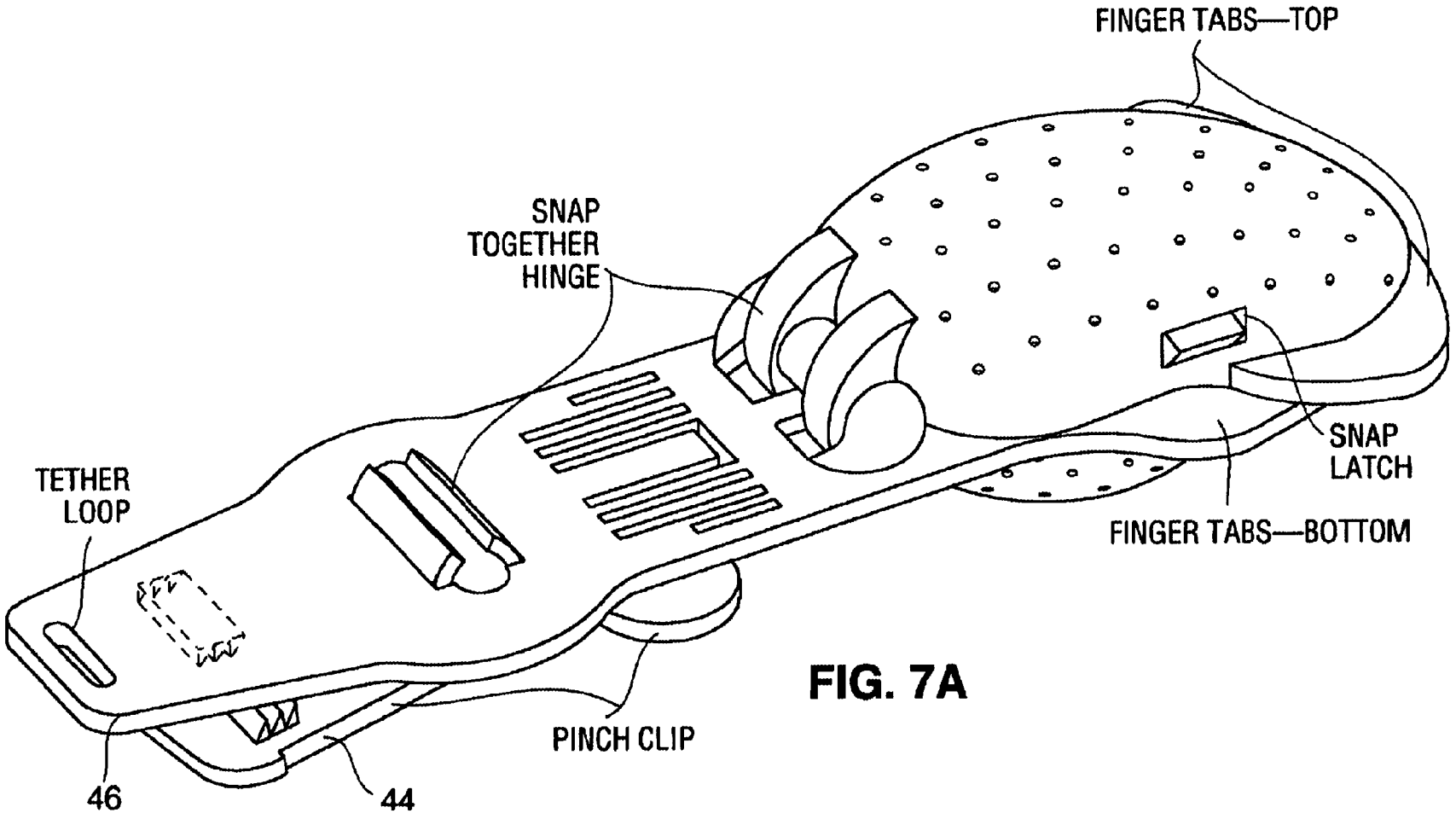
FIG. 7A is a perspective view of a fourth embodiment of the pacifier clip/cover assembly of FIG. 1.
Figure 7B:
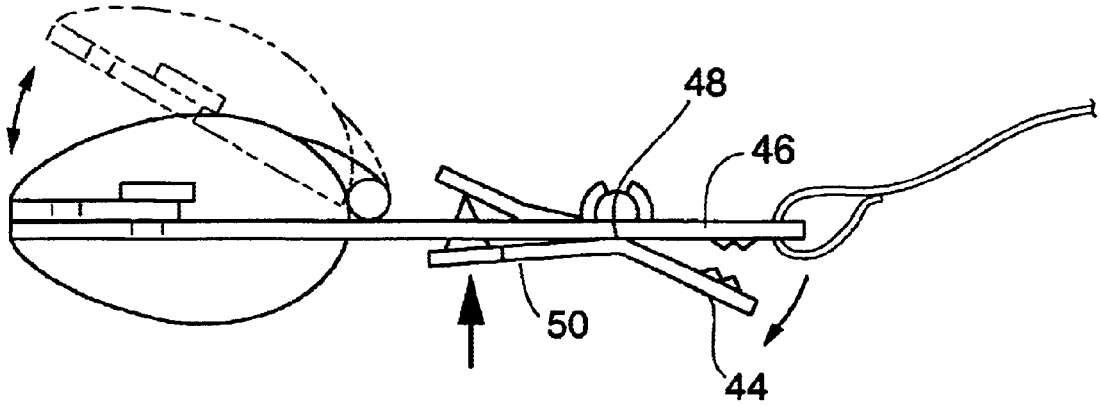
FIG. 7B is a side elevation view of the embodiment of FIG. 7A. Dashed lines indicate the orientation of the cover in the opened position.
Figure 7C:
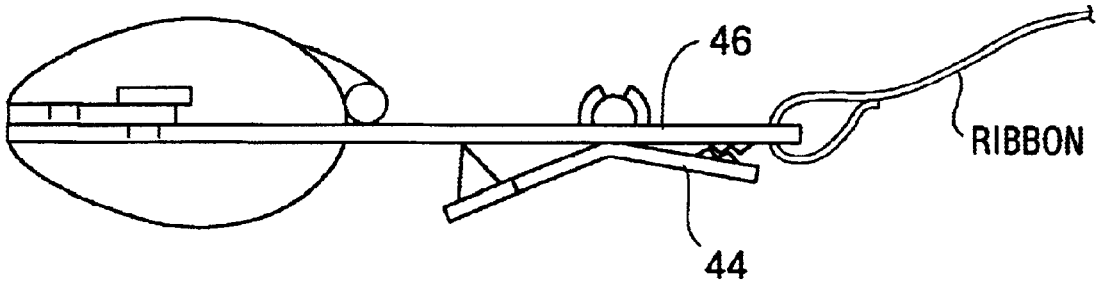
FIG. 7C is a side elevation view similar to FIG. 7B but showing the clip in the closed position.

In a similar embodiment, shown in FIGS. 7A–7C, jaw members 44, 46 and a spring member 48 form a pinch clip, such that squeezing portion 50 of jaw member 44 as shown in FIG. 7C pivots jaw member 44 to the opened position. Various other clip configurations, including standard pinch clips, may alternatively be utilized.

It should be understood that while the forms of the invention herein shown and described constitute preferred embodiments of the invention, they are not intended to illustrate all forms thereof. It also should be understood that the words used are words of description rather than limitation, and various changes may be made without departing without departing from the spirit and scope of the invention disclosed.

What is claimed is:

1. A combination pacifier and clip and cover assembly adapted to be attached to the clothing of an infant for keeping the pacifier from loss and for keeping it clean, the combination comprising:

a pacifier having a nipple;

a clip and cover assembly including a cover covering the pacifier nipple and a clip attached to the cover, wherein the cover is removable from the pacifier nipple, and wherein the clip is attachable to clothing of an infant; and a strap having a first end connected to the clip and cover assembly and a second end connected to the pacifier.

2. The combination of claim 1 wherein the clip includes jaws moveable between open and closed positions.

3. The combination of claim 1 wherein the cover includes a pair of jaw members moveable between an open position for receiving the pacifier nipple and a closed position for securing the pacifier between the jaw members.

4. The combination of claim 3 wherein movement of the jaw members to the closed position forms a cavity between the jaw members for containing the pacifier nipple.

5. The combination of claim 4 wherein at least one of the jaw members includes a recessed portion and wherein the recessed portion comprises a portion of the cavity when the jaw members are in the closed position.

6. The combination of claim 5 wherein each jaw member includes a recessed portion and wherein the recessed portions comprise a portion of the cavity when the jaw members are in the closed position.

7. A combination pacifier and clip and cover assembly adapted to be attached to the clothing of an infant for keeping the pacifier from loss and for keeping it clean, the combination comprising:

a pacifier having a nipple and a mouthpiece;

a clip and cover assembly including a cover covering the pacifier nipple independently of the mouthpiece of the pacifier, and a clip attached to the cover, wherein the cover is removable from the pacifier nipple, and wherein the clip is attachable to clothing of an infant; and a strap having a first end connected to the clip and cover assembly and a second end connected to the pacifier.

8. The combination of claim 7 wherein the clip includes jaws moveable between open and closed positions.

9. The combination of claim 7 wherein the cover includes a pair of jaw members moveable between an open position for receiving the pacifier nipple and a closed position for securing the pacifier between the jaw members.

10. The combination of claim 9 wherein movement of the jaw members to the closed position forms a cavity between the jaw members for containing the pacifier nipple.

11. The combination of claim 10 wherein at least one of the jaw members includes a recessed portion and wherein the recessed portion comprises a portion of the cavity when the jaw members are in the closed position.

12. The combination of claim 11 wherein each jaw member includes a recessed portion and wherein the recessed portions comprise a portion of the cavity when the jaw members are in the closed position.

13. A method for protecting a pacifier comprising the steps of:

providing a clip and cover assembly, the assembly including a clip attachable to an infant's clothing and a cover configured to cover a nipple of a pacifier;

providing a pacifier having a nipple and a mouthpiece, and further providing a strap having a first end connected to the pacifier and a second end connected to the clip and cover assembly;

attaching the clip to an infant's clothing;

with the clip attached to the infant's clothing, covering the nipple of the pacifier with the cover.

14. The method of claim 13 wherein the clip includes jaws and wherein the attaching step includes enclosing a portion of the clothing between the jaws.

15. The method of claim 13 wherein the cover includes jaw members and wherein the covering step includes positioning the jaw members in an opened position, positioning the nipple between the jaw members, and then positioning the jaw members in a closed position to enclose the nipple between the jaw members, leaving the mouthpiece uncovered.

16. The method of claim 15 wherein movement of the jaw members to the closed position forms a cavity between the jaw members for containing the pacifier nipple.

17. The method of claim 16 wherein at least one of the jaw members includes a recessed portion and wherein the recessed portion comprises a portion of the cavity when the jaw members are in the closed position.

18. The method of claim 16 wherein each jaw member includes a recessed portion and wherein the recessed portions comprise a portion of the cavity when the jaw members are in the closed position.

* * * * *